United States Patent [19]

Blake

[11] 4,239,591

[45] Dec. 16, 1980

[54] MANUFACTURE OF AN NON-LAMINATED PAPER WEB HAVING REGIONS OF INCREASED THICKNESS

[76] Inventor: David R. Blake, 11200 Killarney, Onsted, Mich. 49265

[21] Appl. No.: 952,624

[22] Filed: Oct. 19, 1978

[51] Int. Cl.[3] ..... D21H 5/02; D21F 1/00

[52] U.S. Cl. ..... 162/109; 162/123; 162/198; 162/208; 162/213; 162/259; 162/292; 162/299; 162/300; 162/361

[58] Field of Search ..... 162/109, 123, 198, 208, 162/212, 213, 259, 292, 298, 299, 300, 308, 344, 336, 115, 210, 361

[56] References Cited

U.S. PATENT DOCUMENTS

| | | | |
|---|---|---|---|
| 670,847 | 3/1901 | Cornel | 162/115 |
| 762,914 | 6/1904 | Kron | 162/115 |
| 1,605,491 | 11/1926 | Williams | 162/292 |
| 3,119,730 | 1/1964 | Johnson | 162/109 |
| 4,032,394 | 6/1977 | Back | 162/336 |

FOREIGN PATENT DOCUMENTS

| | | | |
|---|---|---|---|
| 1078 | of 1895 | United Kingdom | 162/299 |

*Primary Examiner*—Peter Chin

*Attorney, Agent, or Firm*—Lockwood, Dewey, Alex & Cummings

[57] ABSTRACT

A non-laminated paper sheet product characterized by regions or islands of increased thickness, usually located in the center of the sheet for more economical use of the paper product and for conservation of wood pulp. The regions of increased thickness are formed by depositing or laying additional pulp stock onto a generally uniform thickness paper web in the web-forming area of a paper machine in either wet or dry methods of paper production. Continuous regions of increased thickness in the web can be formed by corresponding variations in the width of the web or by spraying the additional pulp onto the forming web. Islands of increased web thickness can be formed by periodically interrupting pulp stock depositing sprayheads disposed at spaced locations across the width of the forming web, with timing devices or web thickness sensors controlling the sprayheads.

7 Claims, 7 Drawing Figures

12
13
14
16
23
24
25
26
27
28
29
31
32
34
35
36
37
38
39
40

MANUFACTURE OF AN NON-LAMINATED PAPER WEB HAVING REGIONS OF INCREASED THICKNESS

BACKGROUND OF THE INVENTION

This invention relates in general to the production of paper sheet products and is more particularly concerned with improvements in the production of non-laminated paper sheet products having regions of increased thickness for more economical use of the paper products and for conservation of wood pulp.

It has been customary in paper making to attempt to control the thickness of the web being formed to be as uniform as possible in thickness. Thus, sheets of paper cut from the web in either the wet or dry papermaking processes are usually of quite uniform thickness when the paper is viewed in its entirety. Upon much closer investigation, such as under microscopic viewing, differences in thickness are inherent since the pulp fibers cannot be so uniformly laid or dispersed during the papermaking processes so as to avoid any thickness variation on the microscopic level.

Various processing techniques are also known to the prior art to give uniform thickness sheet paper differing or modified characteristics. For example, softer texture can be imparted to relatively thin sheet paper by creping the paper, as by removing the paper from a calendar roll by a doctor. Such processing techniques after the paper has been formed have also been concerned with creating a finished product which has a generally uniform overall appearance.

Usage of paper, on the other hand, does not generally require that the paper be of entirely uniform thickness. For example, paper towels are more frequently used in the center portion than at the edges, especially in soaking up small spills and in drying one's hands. Similarly, in the printing industry, sheets of paper are printed primarily in the center portion such that the margins could be of reduced thickness to reduce the amount of wood pulp and other raw material utilized. Significant amounts of energy could also be conserved in the manufacture of paper of non-uniform thickness with additional energy savings gained in the transportation and further processing of such paper.

The concepts of the present invention could also be utilized to provide increased strength and support in the thicker portions of the paper sheet without the need for special or extra apparatus to add or inject high-strength fibers into the paper web as it is being formed. For example, it has been customary in the manufacture of heavy-duty paper bags suitable for containing and carrying groceries to manufacture such bags from multiple layers or plys of paper sheet stock, each sheet being of uniform thickness. There is, of course, a considerable waste of wood pulp in manufacturing these bags since the same paper thickness is not needed throughout the bag. With the present invention increased thicknesses of pulp can be provided along the areas or points of stress, such as along seams, creases and the top opening of the bag. The balance of the bag can be of reduced thickness of paper for considerable wood pulp savings.

Conversely, the present invention can be utilized to make paper thinner in desired areas by laying less pulp to provide other characteristics, such as increased flexibility along folded portions of the paper where the paper is otherwise of sufficient strength.

It is, therefore, a principal object of the present invention to provide novel and improved apparatus and methods for the manufacture of non-laminated paper sheet stock having regions of increased thickness to reduce the wood pulp requirements in manufacturing paper and thereby conserve wood pulp.

Another object of the invention is to increase the utilization of wood pulp by providing regions of extra thickness, strength and absorbability at those locations in paper sheet stock where the paper is most used.

A further object is to conserve energy by reducing the thickness and weight of the paper in those locations where the paper sheet is least used thereby requiring less energy to dry, transport or further process the paper.

Yet another object is to provide means for automatically depositing extra pulp in locations on the web being formed by either wet or dry papermaking machines such that the areas of increased thickness are an integral part of the paper web and the resultant paper sheet product does not substantially lose its inherent flexibility as in laminated paper products.

Another object of the invention is to provide means for automatically controlling the deposition of extra pulp being formed by the papermaking machine such that the web may be automatically cut into sheets or strips of paper with the areas of increased thickness registered in the desired positions.

SUMMARY OF THE INVENTION

These objects and advantages of the invention, and others, including those inherent in the invention, are accomplished by adding regions of extra pulp to the paper in the web forming area of a papermaking machine such that the regions of increased thickness become an integral part of the paper web, and hence, of the paper sheet products into which the web is cut or further processed. The areas of increased thickness are preferably sized and located in the areas of primary use for the particular paper sheet product such that the paper sheet products will be most efficiently utilized and wood pulp may be conserved. The areas of increased thickness can be formed in a conventional Fourdrinier wet papermaking machine including a head box for containing a quantity of pulp stock, an endless forming screen disposed below the head box and a slice formed in the head box adjacent the screen wherein the slice is provided with variations in thickness at spaced locations therealong such that corresponding variations in the thickness of pulp are deposited onto the forming screen to yield a paper sheet product having the desired regions of increased thickness. The variations in the thickness of the slice could be permanent, adjustable, or mechanically moveable as the paper is being formed. Alternatively, the additional pulp to create the thicker regions may be separately sprayed or otherwise deposited onto a continuous paper web of generally uniform thickness in the web-forming area of the papermaking machine in either the wet or dry papermaking processes. A plurality of sprayheads may be positioned at spaced locations above and across the width of the web, each adapted to spray additional quantities of pulp stock onto the paper web. Valves or other means in the sprayheads may periodically interrupt the deposition of additional pulp stock to form islands of increased thickness in the paper web. Web thickness sensing means, such as photo-electric devices, may be located downstream of the spraying heads to detect the regions of increased thickness in the paper to automatically interrupt deposition of the pulp stock by spraying heads.

BRIEF DESCRIPTION OF THE DRAWINGS

The features of the present invention which are believed to be novel and patentable, are set forth with particularity in the appended claims. The invention together with the further advantages thereof, can best be understood by reference to the following description taken in conjunction with the accompanying drawings, and the several figures in which like reference numerals identify like elements, and in which:

DESCRIPTION OF THE PREFERRED EMBODIMENTS

Figure 1:
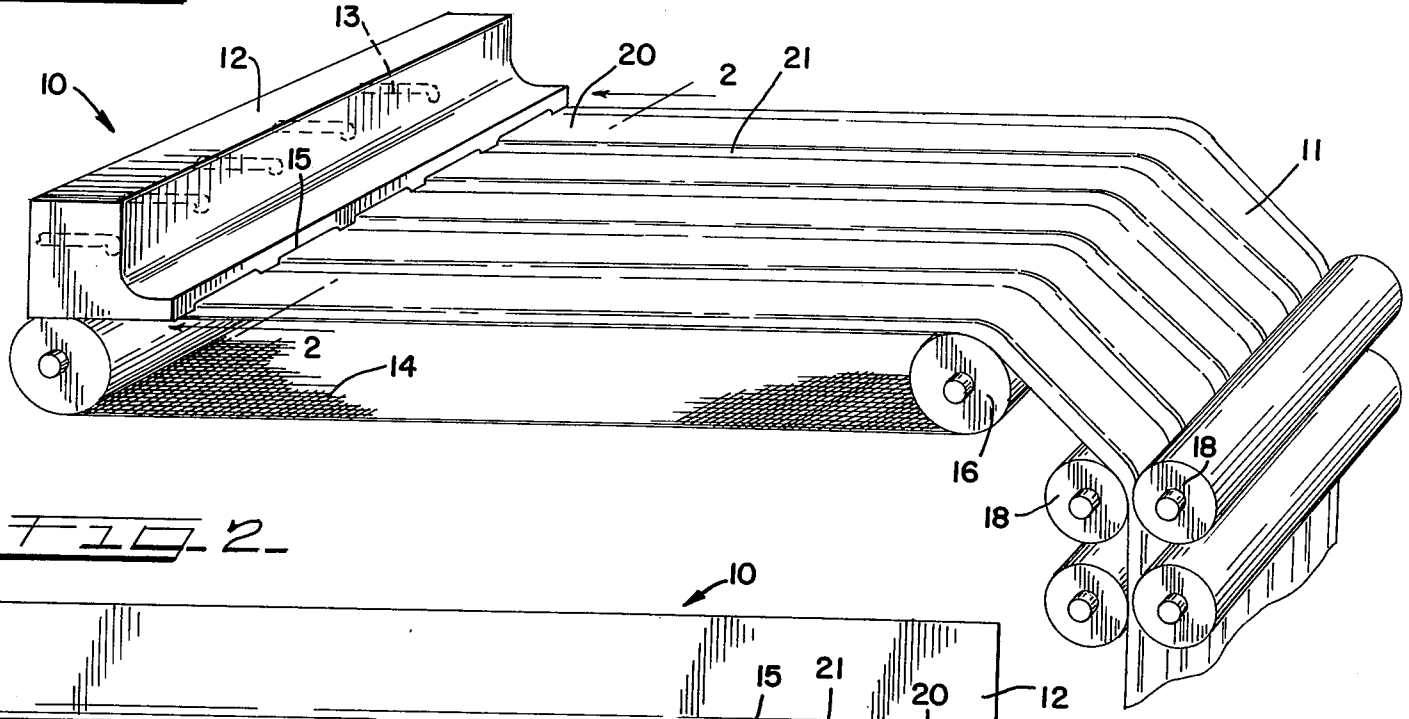
FIG. 1 is a perspective view of the web-forming portion of a papermaking machine of the Fourdrinier type having an endless screen for forming of the paper web thereupon by flowing of pulp stock from the head box through a slice onto the screen and further illustrating the slice being of differing widths at spaced locations therealong for depositing corresponding thicknesses of pulp stock onto the screen to form a paper web having regions of increased thickness.

Referring to FIG. 1, there is shown a web forming area of a conventional Fourdrinier papermaking machine, generally designated 10, adapted to produce a continuous paper web 11. A head box 12 is adapted to contain a quantity of wood pulp which is supplied to the head box 12 by a plurality of conduits 13 communicating therewith from a pulp storage tank (not shown) or other wood pulp source. Disposed immmediately below the head box 12, in the usual fashion, is an endless forming screen 14. A slice 15 defined in a lower portion of the head box 12 adjacent the screen 14 permits pulp from the head box 12 to flow through the slice 15 and onto the top surface of the screen 14 to begin formation of the paper web 11. The slice 15 is generally of narrow vertical width to limit and control the amount of pulp which flows out of the head box 12 onto the screen 14. However, the slice 15 is quite elongated and extends approximately the entire horizontal width of the web 11 or of the screen 14, as is best seen in FIG. 2.

The top portion of the screen 14 upon which the web 11 is formed is adapted to move forwardly from the slice 15 toward a couch roller 16. As the screen 14 begins to move downwardly about the couch roller 16 and thence back toward the head box 12, the web 11 is delivered from the screen 14 to a plurality of web-engaging rollers 18 which may comprise a part of the dryer section of the papermaking machine 10. While the web 11 is advancing on the screen 14 away from the slice 15, i.e. in the downstream direction, excess water is permitted to drip through the screen 14. The couch roller 16 may be adapted to remove additional water from the web 11 as by applying a vacuum through the screen 15 to the underside of the web 11.

In accordance with one aspect of the invention, the slice 15 varies in vertical width at spaced locations along the horizontal width of the web 11 such that additional quantities of pulp are permitted to flow through the slice 15 to form regions or continuous bands 20 of increased thickness in the web 11 as compared to the normal thickness portions 21. Since the increased thickness regions 20 are simultaneously formed with the normal thickness portions 21, the increased thickness regions 20 will be an integral part of the web 11. While FIGS. 1 and 2 illustrate the increased thickness regions 20 comprising a larger proportion of the web 11 than the normal thickness portions 21, it will be appreciated that the thicker regions 20 could comprise only a small percentage of the web 11, depending upon the end use of paper sheet products made from the web 11.

Figure 2:
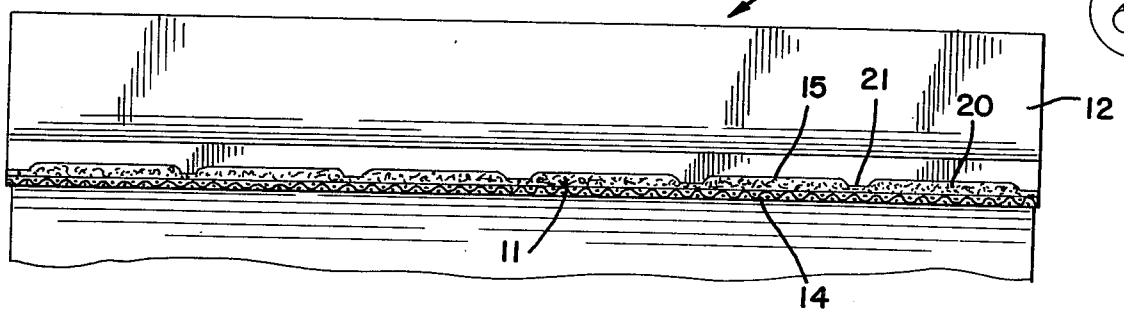
FIG. 2 is a front elevational view, partially in section, of the papermaking machine in FIG. 1 taken substantially along the line 2—2 to illustrate the regions of increased thickness in the paper web.

The slice 15, which is of generally uniform vertical width in a conventional papermaking machine, can be permanently altered in vertical height at spaced locations therealong, as illustrated in the preferred embodiment of the invention in FIGS. 1 and 2, to provide the web 11 with the increased thickness portions 20 and the normal thickness portions 21. On the other hand, it will be apparent to those skilled in the art that means, such as adjustable plates or the like, could be provided to selectively mask off portions of a uniform width slice to yield the desired arrangement of increased thickness regions 20 and normal thickness portions 21 in the web 11. Of course, the width of the slice could be controlled mechanically as by cams, electrically as by solenoids, or hydraulically. More elaborate controls, such as computers and programming thereof or various forms of numerical control known to the prior art, could be utilized to create more intricate patterns in the paper thickness, including embossing effects, by instantaneously controlling the width of the slice 15 at the desired spaced locations.

Figures 3, 4, 5, 6, 7:
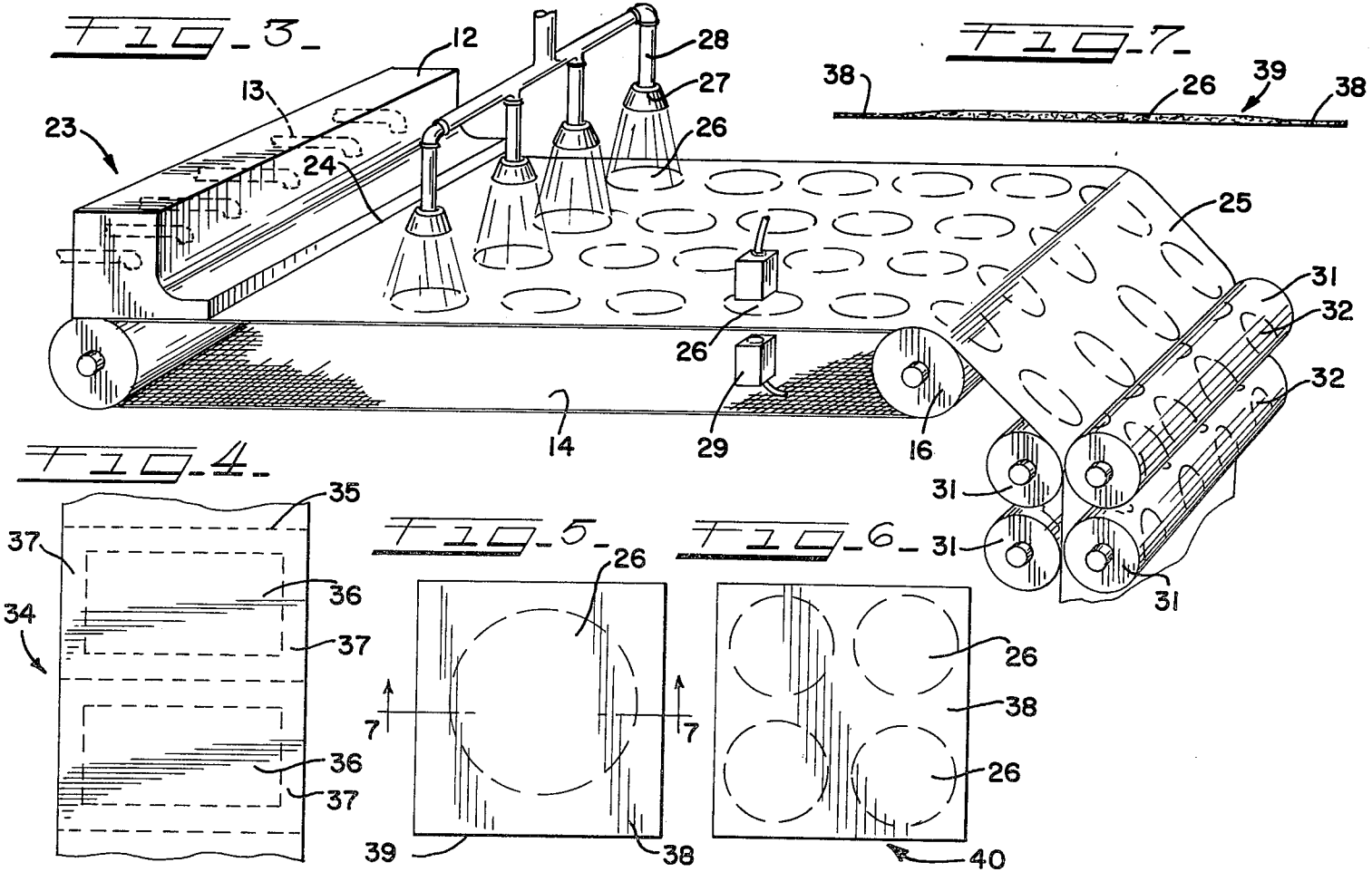
FIG. 3 is a perspective view of the web forming area of another papermaking machine illustrating spraying heads disposed above and across the width of the paper web for depositing extra thicknesses of pulp thereupon, with web thickness sensing means located downstream from the spraying heads, and further illustrating downstream rollers which are profiled to accommodate the regions of increased thickness in the web.
FIG. 4 is a top plan view of a strip of paper, such as toweling, substantially in sheet form and having centrally disposed rectangular regions of increased thickness.
FIG. 5 is a top plan view of another paper sheet product having a single generally circular region or island of increased thickness.
FIG. 6 is a top plan view of another type of paper sheet product having a plurality of increased thickness regions disposed in the sheets.
FIG. 7 is a cross sectional view of the paper sheet product of FIG. 5 taken substantially along the line 5—5 and illustrating the increased thickness center region and reduced thickness edges or margins.

With reference to FIG. 3, there is shown another embodiment of a papermaking machine 23 which utilizes a slice 24 of uniform vertical width to form a web 25 of substantially uniform thickness on the screen 14. In accordance with another aspect of the invention, means are provided to deposit or lay additional amounts of wood pulp onto the uniform thickness paper web 25 in the web forming area of the machine 23 such that the additional amounts of pulp create regions or islands 26 of increased web thickness. The means for depositing the additional pulp onto the web 25 may include a plurality of spraying heads 27 disposed above the web 25 at spaced locations across the width of the web with the spraying heads 27 each connected to a source of pulp by the conduits 28. The spraying heads 27 may be arranged and operated to provide a variety of patterns of increased web thickness. The individual spraying patterns of each spraying head 27 may also contribute to different web thickness patterns. For example, if the heads 27 continuously deposit additional pulp onto the web 25, continuous bands as illustrated in FIGS. 1 and 2 may be added to the web in FIG. 3 or the spraying heads 27 may be operated in an on and off manner, as by valves contained in the spraying heads 27 or the conduits 28, to create isolated regions or islands 26 as illustrated in FIG. 3. If additional spraying heads are provided further away from the slice 24 than the spraying heads 27 illustrated in FIG. 3, additional thicknesses of wood pulp can be deposited onto the web 25, some of which may be in overlying relationship to the islands 26 formed by the heads 27. The pressure in the spraying heads 27 must be sufficient to move the pulp therethrough, but also must be sufficiently low so as not to puncture the web 25 when spraying the additional pulp thereon. Alternate on and off action of the spraying heads 27 may be controlled by conventional timing devices or by a photoelectric sensing device 29, located intermediate the spraying heads 27 and the couch roller 16, which provides an output signal indicative of the thickness of the web 25. The spraying heads 27 will be responsive to the output signal of the sensor 29 and thereby automatically repeat the pattern of regions of increased pulp thickness on the web 25. The output signal of the photoelectric sensor 29 or other control device which controls the sprayings heads 27 may also be utilized in controlling other processing operations, such as synchronous cutting of the web 25 into sheets or strips of paper with the islands 26 of increased web thickness thereby automatically positioned or registered in the sheet or strip.

In accordance with another aspect of the invention, at least some of the web engaging rollers 31 may be profiled to contain recessed areas 32 corresponding to the islands 26 in the web 25 such that the increased web thickness provided by the islands 26 is not unduly compressed by further processing of the web 25. Synchronization of the drive of the rollers 31 can be provided by the output signal of the photoelectric sensor 29 in a manner analogous to the control and registration of printing press rollers.

A wide variety of paper sheet products possessing increased regions of web thickness can be produced by the machines in FIGS. 1-3. As illustrated in FIG. 4, a continuous strip 34 of sheet paper may be cut or slit from the webs 11, 25 and perforated, as at 35, to define separate, but connected, sheets each having a central regions 36 of increased paper thickness with margins 37 of reduced paper thickness. The thickness of the center portion 36 is most advantageous in paper toweling, toilet tissue or the like where the center of the strip 34 is more frequently used than the thinner margins 37. This insures that the wood pulp comprising the strip 34 is most efficiently used and wood pulp is conserved. It will be readily apparent that other paper products, such as facial tissue and printing paper could be made in a manner similar to the strip 34. Printing processes could be synchronized with the increased thickness region 36, in a manner analogous to use of the photoelectric sensor 29 in depositing additional pulp on the web 25, to provide the desired thickness and opacity of the paper in the printed region and yet conserve pulp by making the marginal areas 37 of the page of reduced thickness.

Illustrated in FIGS. 5 and 6 are other arrangements of islands 26 of increased paper thickness, of generally circular configuration, surrounded by areas 38 of reduced thickness in the respective sheets 39, 40. As best seen in FIG. 7, typically the region of increased paper thickness 26 will blend or feather into the reduced thickness margins 38, rather than forming an abrupt change in thickness at the junction of the region 26 with the margins 38. The ratios of the thickness of the region 26 to the margins 38 can vary considerably depending on the end use of the paper sheet product. For example, the region 26 could be only a few percent thicker than the margins 38, or could be several times the thickness of the margins 38. Of course, the amount of pulp conserved by the invention will be dependent upon the difference in thickness between the increased thickness regions 26 to the margins 38 as well as the percentage of the web 25 occupied by the regions 26 to that occupied by the margins 38.

The advantages of the present invention can also be utilized to provide extra strength to the desired areas of the paper sheet product without the need for additional apparatus to add or inject higher strength fibers into the desired positions in the web formed by the papermaking machines 10, 23. Instead, the relative strength of portions of the paper sheet can be controlled by the thickness of pulp laid while forming the web, from which the sheet is later cut.

Yet another feature is the ability to deposit the additional pulp in a different color especially in the papermaking machine 23 wherein the pulp for the head box 12 and for the spraying heads 27 may come from different sources.

Since the additional pulp is laid or deposited in the web forming area of the machine, the additional pulp is formed with the web as an integral part thereof. Thus, the web and the paper sheet products made from the web maintain a high degree of flexibility and absorbability which is important in personal paper products, such as facial tissues, and in other paper sheet products such as paper toweling.

It is not expected that the packaging of paper products comprising regions of differing thickness in accordance with this invention will be troublesome, since the regions of increased thickness can be designed to aid in the packaging. For example, the regions of increased thickness can be staggered or stepped where the paper sheet product is packaged in a box, such as facial tissues. Similarly, rolling of strips of paper sheet products having differing areas of thickness will also result in staggered positioning of such thicker areas upon each other. Additionally, many paper products in rolls, such as paper toweling or toilet tissue are loosely rolled to avoid compression of the paper and to preserve the absorbability characteristics. Furthermore, in many paper products the difference in thickness between the narrower and thicker portions will not be so substantial as to cause packaging problems.

It will be understood that various changes and modifications may be made without departing from the spirit of the invention as defined in the following claims.

I claim:

1. An improvement in a papermaking machine of the fourdrinier type including means for flowing a quantity of pulp stock onto an endless forming screen positioned therebelow to produce a paper web of substantially uniform thickness, said improvement comprising at least one spraying head spaced from the web in the web forming area, means for supplying pulp to said at least one spraying head, said at least one spraying head being directed toward said web to spray additional quantities of pulp stock onto the uniform thickness web, and means to periodically interrupt the deposition of additional pulp stock by said spraying head to create a plurality of isolated regions of increased thickness corresponding to said at least one spraying head integral with the paper web, and roller means downstream from said web forming area for compressing said web to form a paper sheet, said roller means comprising a web-engaging surface comformable with said region of increased thickness to form a paper sheet having a corresponding region of increased thickness.

2. The improvement in claim 1 wherein said means to periodically interrupt the deposition of additional pulp stock comprises sensing means downstream of the spraying head to detect regions of increased thickness in the paper and to generate an output signal responsive thereto and means responsive to said output signal for interrupting the flow of pulp stock in said spraying head.

3. The improvement in claim 1 wherein there are a plurality of stationary spraying heads spaced across the width of said web.

4. The improvement of claim 1 wherein said web-engaging surface includes recessed surface portions to engage said regions of increased thickness to produce said compressed sheets.

5. The improvement of claim 1 comprising a single sprayhead centrally positioned relative to said web to form said region of increased thickness centrally in the web, the other portions comprising reduced thickness margins of the web.

6. A papermaking process comprising the steps of flowing a quantity of pulp stock onto an endless forming screen to form a paper web of substantially uniform thickness, periodically spraying additional quantities of pulp stock from at least one sprayhead onto the web in the web forming area to form isolated regions of increased thickness corresponding to the deposition of pulp from said at least one sprayhead, said thickened regions forming an integral part of said web, and compressing said web with roller means downstream of said web forming area to form a paper sheet, said roller means comprising a web-engaging surface conformable with said region of increased thickness.

7. The papermaking process as in claim 6 further comprising the additional steps of sensing the paper thickness downstream of the web forming area generating an output signal responsive thereto, and interrupting the deposition of pulp stock in response to said signal.

* * * * *